US009140502B2

(12) United States Patent
Kaslusky et al.

(10) Patent No.: US 9,140,502 B2
(45) Date of Patent: Sep. 22, 2015

(54) ACTIVE STRUCTURES FOR HEAT EXCHANGER

(75) Inventors: Scott F. Kaslusky, West Hartford, CT (US); Brian St. Rock, Andover, CT (US); Jaeseon Lee, Glastonbury, CT (US); Yirong Jiang, Ellington, CT (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 1266 days.

(21) Appl. No.: 12/832,434

(22) Filed: Jul. 8, 2010

(65) Prior Publication Data

US 2012/0006511 A1 Jan. 12, 2012

(51) Int. Cl.

| | |
|---|---|
| ***F28F 13/12*** | (2006.01) |
| ***F28F 13/06*** | (2006.01) |
| *H05K 7/20* | (2006.01) |

(52) U.S. Cl.

CPC ..... *F28F 13/06* (2013.01); *F28F 13/12* (2013.01); *F28F 13/125* (2013.01)

(58) Field of Classification Search

CPC ..... F28F 13/02; F28F 13/12; F28F 13/06; F28F 1/1253

USPC ..... 165/109.1, 83.3, 104.33, 104.34, 149; 361/697, 703, 704

See application file for complete search history.

(56) References Cited

U.S. PATENT DOCUMENTS

| | | | | |
|---|---|---|---|---|
| 3,363,682 | A * | 1/1968 | Hartley | 165/181 |
| 4,708,198 | A * | 11/1987 | Holl | 165/109.1 |
| 4,780,062 | A | 10/1988 | Yamada et al. | |
| 4,815,531 | A * | 3/1989 | Presz et al. | 165/151 |
| 4,923,000 | A | 5/1990 | Nelson | |
| 5,335,143 | A | 8/1994 | Mailing, Jr. et al. | |
| 5,422,787 | A * | 6/1995 | Gourdine | 361/697 |
| 5,522,712 | A | 6/1996 | Winn | |
| 5,921,757 | A | 7/1999 | Tsutsui et al. | |
| 6,244,331 | B1 | 6/2001 | Budelman | |
| 6,349,761 | B1 * | 2/2002 | Liu et al. | 165/151 |
| 6,419,007 | B1 | 7/2002 | Ogawara et al. | |
| 6,479,895 | B1 | 11/2002 | Lee et al. | |
| 6,505,680 | B1 | 1/2003 | Hegde | |
| 6,525,939 | B2 | 2/2003 | Liang et al. | |
| 6,535,385 | B2 | 3/2003 | Lee | |
| 6,543,522 | B1 | 4/2003 | Hegde | |
| 6,587,341 | B1 | 7/2003 | Wei | |
| 6,633,484 | B1 | 10/2003 | Lee et al. | |
| 6,657,862 | B2 | 12/2003 | Crocker et al. | |

(Continued)

FOREIGN PATENT DOCUMENTS

| | | | |
|---|---|---|---|
| EP | WO02093643 | A1 | 11/2002 |
| GB | 2377321 | A | 5/2001 |

*Primary Examiner* — Tho V Duong
(74) *Attorney, Agent, or Firm* — Cantor Colburn LLP

(57) ABSTRACT

A heat exchanger includes a plurality of channels and one or more active flow disruption members disposed at an entrance to the plurality of channels. The active flow disruption members are configured to induce unsteadiness in a flow through the plurality of channels to increase thermal energy transfer in the plurality of channels. A method for transferring thermal energy from a heat exchanger includes locating one or more active flow disruption members at an entrance to a plurality of channels of the heat exchanger. A flow is directed across the one or more active flow disruption members into the plurality of channels and an unsteadiness is produced in the flow via the one or more active flow disruption members. The unsteadiness in the flow increases the transfer of thermal energy between the heat exchanger and the flow.

6 Claims, 6 Drawing Sheets

(56) References Cited

U.S. PATENT DOCUMENTS

| | | | | |
|---|---|---|---|---|
| 6,659,169 | B1 | 12/2003 | Lopatinsky et al. | |
| 6,664,673 | B2 | 12/2003 | Lopatinsky et al. | |
| 6,671,172 | B2 | 12/2003 | Carter et al. | |
| 6,714,415 | B1 | 3/2004 | Shah | |
| 6,755,242 | B2 | 6/2004 | White | |
| 7,120,020 | B2 | 10/2006 | Carter et al. | |
| 7,147,049 | B2 * | 12/2006 | Lee et al. | 165/166 |
| 7,188,418 | B2 | 3/2007 | Shah | |
| 7,193,849 | B2 | 3/2007 | Xu et al. | |
| 7,200,934 | B2 | 4/2007 | Carter et al. | |
| 7,355,856 | B2 * | 4/2008 | Petroski | 361/710 |
| 7,361,081 | B2 | 4/2008 | Beitelmal et al. | |
| 7,714,433 | B2 | 5/2010 | Campini et al. | |
| 7,760,506 | B1 | 7/2010 | Wang et al. | |
| 7,814,967 | B2 | 10/2010 | Harman | |
| 7,911,790 | B2 | 3/2011 | Carter et al. | |
| 7,961,462 | B2 * | 6/2011 | Hernon | 361/694 |
| 7,983,045 | B2 * | 7/2011 | Bhattacharya et al. | 361/707 |
| 2002/0171139 | A1 | 11/2002 | Lee et al. | |
| 2003/0046967 | A1 | 3/2003 | Pollard, II et al. | |
| 2006/0042777 | A1 | 3/2006 | Delano et al. | |
| 2006/0187642 | A1 | 8/2006 | Jeong | |
| 2008/0062644 | A1 * | 3/2008 | Petroski | 361/695 |
| 2009/0190302 | A1 | 7/2009 | Bhattacharya et al. | |
| 2010/0047092 | A1 | 2/2010 | Erturk et al. | |
| 2010/0284839 | A1 | 11/2010 | Chou | |
| 2010/0302730 | A1 * | 12/2010 | Hernon | 361/694 |

* cited by examiner

ACTIVE STRUCTURES FOR HEAT EXCHANGER

BACKGROUND OF THE INVENTION

The subject matter disclosed herein relates to thermal energy transfer. More specifically, the subject disclosure relates to active structures for enhancement to thermal energy transfer in, for example, a heat exchanger.

A heat exchanger transfers thermal energy to a flow through channels in the heat exchanger from a structure surrounding the channels. The thermal energy in the structure is then removed from the system via the cooling flow. The art would well receive means of increasing the heat transfer in the heat exchanger channels.

BRIEF DESCRIPTION OF THE INVENTION

According to one aspect of the invention, a heat exchanger includes a plurality of channels and one or more active flow disruption members disposed at an entrance to the plurality of channels. The active flow disruption members are configured to induce unsteadiness in a flow through the plurality of channels to increase thermal energy transfer in the plurality of channels.

According to another aspect of the invention, a heat exchanger includes a plurality of channels and one or more a frame assemblies. The frame assembly includes a frame and one or more active flow disruption members affixed to the frame and disposed at an entrance to the plurality of channels. The one or more active flow disruption members are configured to induce unsteadiness in a flow through the plurality of channels to increase transfer of thermal energy therein.

According to yet another aspect of the invention, a method for transferring thermal energy from a heat exchanger includes locating one or more active flow disruption members at an entrance to a plurality of channels of the heat exchanger. A flow is directed across the one or more active flow disruption members into the plurality of channels and an unsteadiness is produced in the flow via the one or more active flow disruption members. The unsteadiness in the flow increases the transfer of thermal energy between the heat exchanger and the flow.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
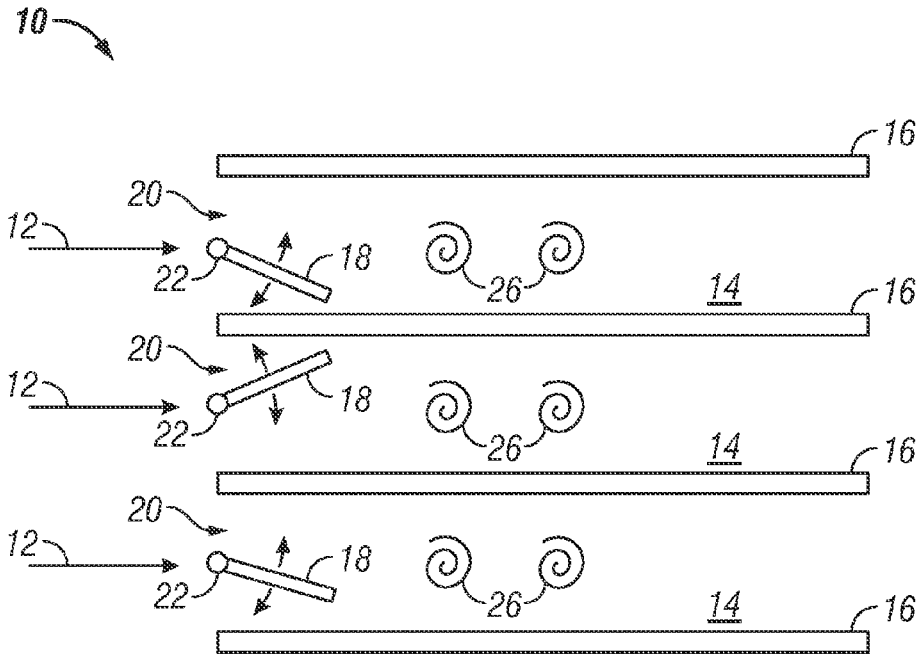
FIG. 1 is a schematic of an embodiment of a heat exchanger including one or more active vibratory members actuated by the flow.

Shown in FIG. 1 is a schematic of an embodiment of a heat exchanger 10. A flow 12, of for example, air flows through a plurality of channels 14, the sides of which are defined by a plurality of heat transfer fins 16. As the flow 12 travels through the channels 14, thermal energy is transferred from the heat transfer fins 16 to the flow 12. The flow 12 may be induced by a source such as a blower (not shown).

An active flow disruption member, for example, an active vibratory member such as a rigid tab 18 is located at the entrance 20 of each channel 14. Each tab 18 is secured in the entrance 20 via, for example a wire 22 or torsional spring. Further, the tab 18 is disposed at an angle to the incoming flow 12 such that the tab 18 is deflected about an axis defined by the wire 22 by the flow 12. The wire 22 holding the tab 18 is set with a tension such that a resonant frequency of the tab 18 vibration held by the wire 22 is at or near a vortex shedding frequency of the tab 18. As flow 12 is directed across the tab 18 and into the channel 14, the tab 18 is actuated and induces unsteadiness in the flow 12, such as modulated flow, pulsed flow, and/or vortex generation. For example, vortices 26 shed off the tab 18 resulting in vibration of the tab 18 which, in turn, increases mixing of the flow 12 and reduces thermal boundary layer thickness in the channel 14 to improve transfer of thermal energy to the flow 12 from the heat transfer fins 16.

Figure 2:
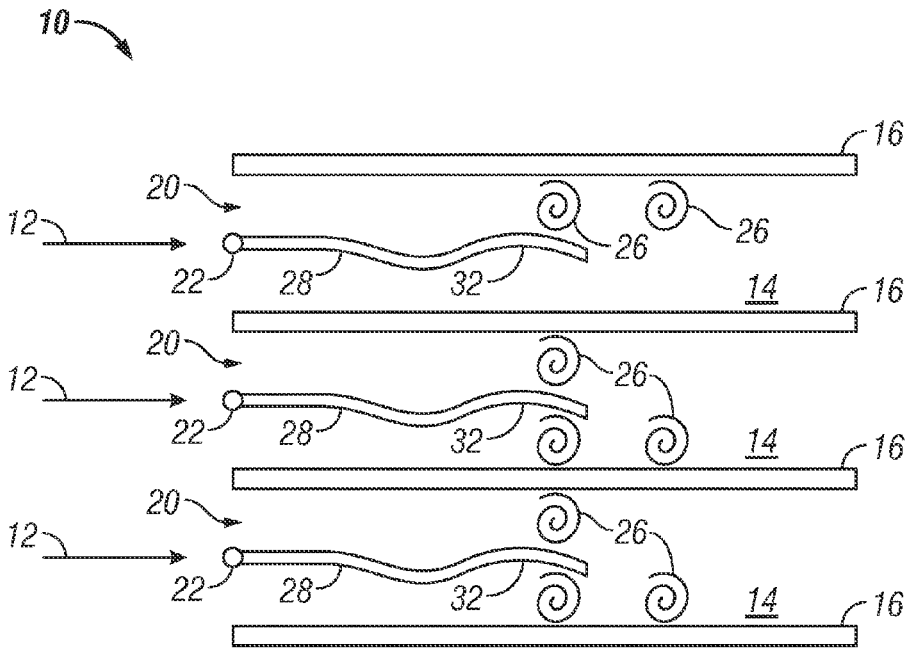
FIG. 2 is a schematic of another embodiment of a heat exchanger including one or more active vibratory members.

Referring to FIG. 2, in some embodiments the active vibratory member may be a flexible member, such as a ribbon 28, flag, or windsock, disposed at the entrance 20 to the channels 14 and extending at least partially along a length 30 of the channels 14. When subjected to the flow 12 entering the channel 14, the ribbon 28 will undulate or flap under a variety of flow conditions. The flapping results from an instability of the flow 12 over a longitudinal surface 32 of the ribbon 28 which increases along a ribbon length. The ribbon 28 induces flow unsteadiness such as vortices 26 which are shed along the ribbon length 34 and such vortex shedding is amplified by flapping of the ribbon 28. The flapping of the ribbon 28 together with the vortices 26 shed by the ribbon 28 increase mixing of flow 12 in the channel 14 resulting in an increase of thermal energy transfer from the heat transfer fins 16 to the flow 12.

Figure 3:
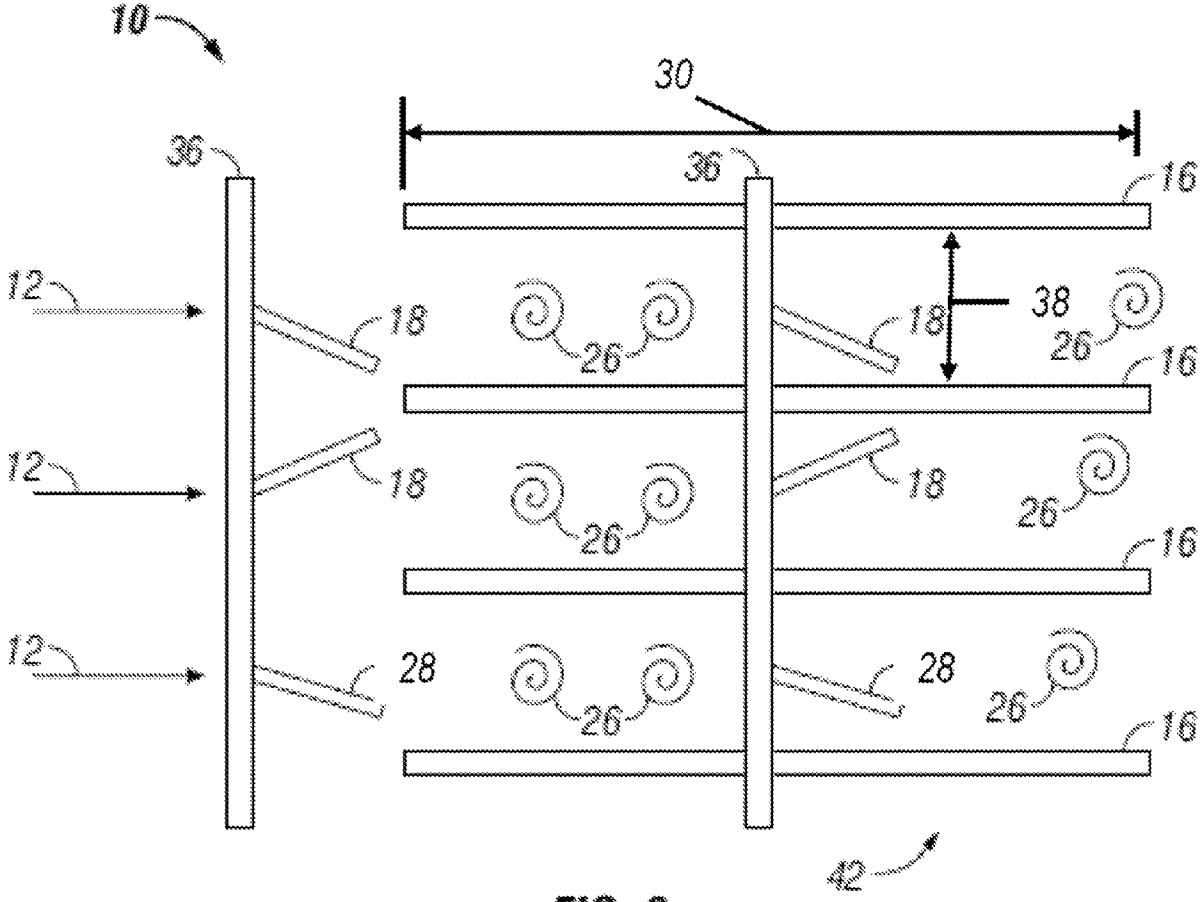
FIG. 3 is a cross-sectional view of an embodiment of a heat exchanger including one or more frame assemblies for active vibratory members.

As shown in FIG. 3, in some embodiments, the ribbons 28 or tabs 18 are arranged in an array and secured to a support structure, for example a frame 36. The ribbons 28 or tabs 18 are located at either at a center of a width 38 of each channel 14, or at a heat transfer fin 16 which separates adjacent channels 14. In some embodiments, the ribbons 28 or tabs 18 span two or more channels 14. In such cases the ribbons 28 or tabs 18 also induce pulsating flow in the channels 14 which further increases the thermal energy transfer. The frame 36 including the ribbons 28 or tabs 18 is placed at the heat exchanger 10 such that the tabs 18 or ribbons extend along a primary direction of the incoming flow 12. If so desired, the heat exchanger 10 may be segmented along the length 30 of the channels 14 with frames 36 including ribbons 28 or tabs 18 between adjacent segments 42 of the heat exchanger 10. Multiple frames 36 arranged along the length 30 extend the mixing of the flow 12 along the length 30 thus extending the improvements in heat transfer from the heat transfer fins 16 to the flow 12.

Figure 4:
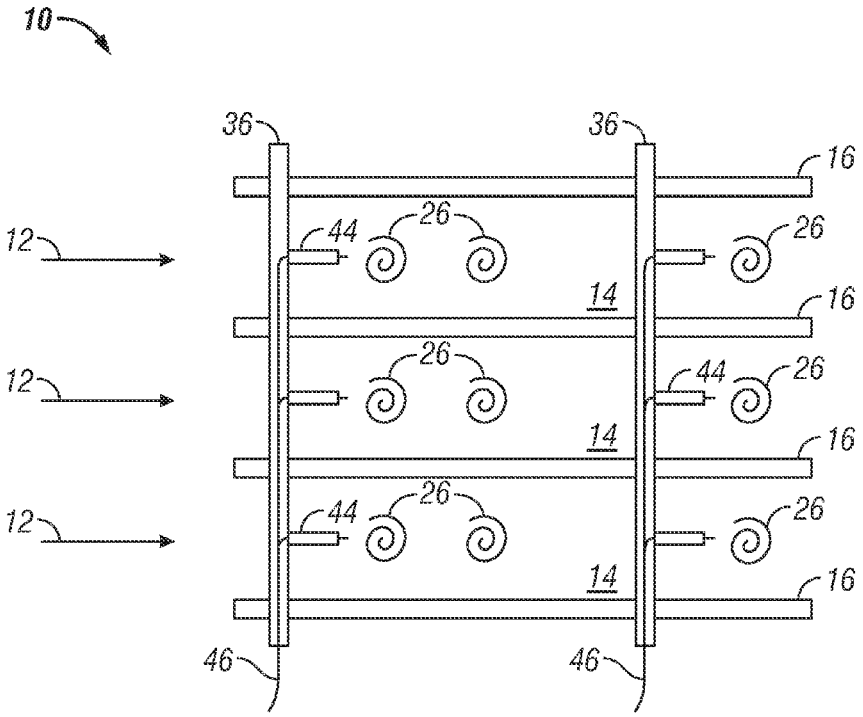
FIG. 4 is another cross-sectional view of an embodiment of a heat exchanger including one or more frame assemblies.

In some embodiments, as shown in FIG. 4, the frame 36 may be used in conjunction with a plurality of active electrically actuated active members, such as piezo-electric reeds 44, fixed to the frame 36 to provide induce the flow unsteadiness such as the mixing vortices 26. The piezo-electric reeds 44 are activated by an electric current delivered to each reed 44 via one or more conductors 46. In some embodiments, the conductors 46 are integrated into the frame 36 structure. When activated, the reeds 44 vibrate at a predetermined frequency generating unsteadiness, such as vortices 26, in the flow 12 in the channels 14. The reeds 44 also impart a thrust force on the flow 12 to offset an increased pressure drop in the channels 14.

Figure 5:
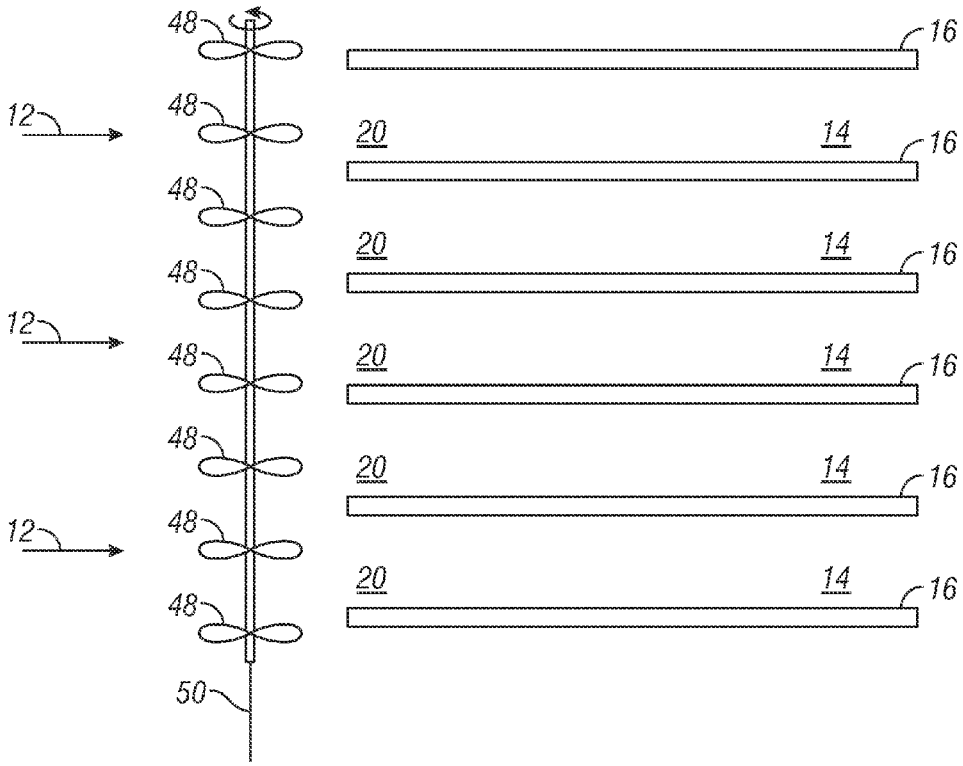
FIG. 5 is a cross-sectional view of another embodiment of a heat exchanger with active rotating elements.
Figure 6:
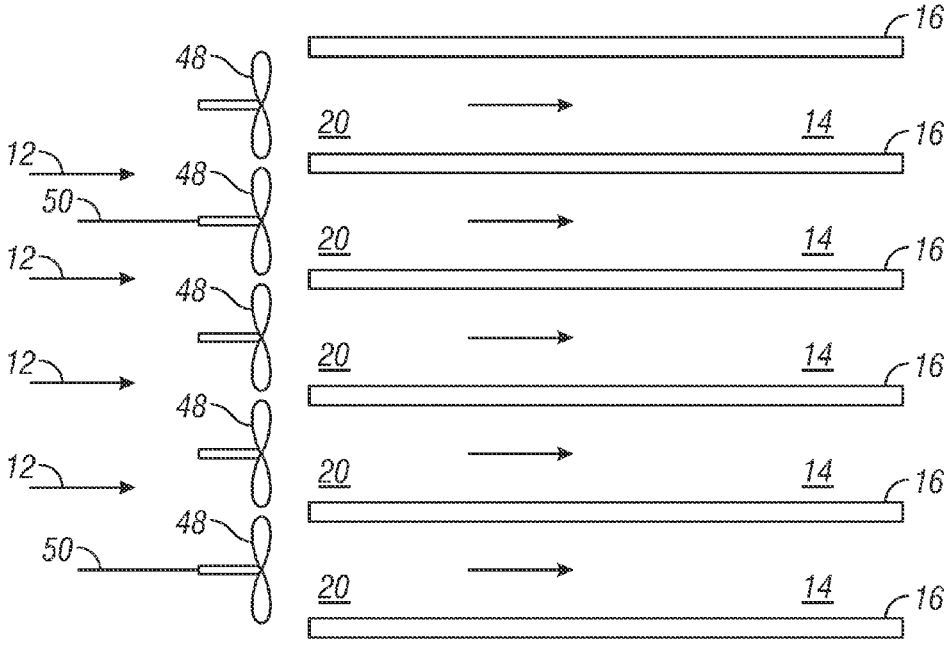
FIG. 6 is a cross-sectional view of yet another embodiment of a heat exchanger with active rotating elements.

Another embodiment is shown in FIG. 5. In FIG. 5, a plurality of rotating fans 48 are located at the entrance 20 to the channels 14. These fans 48 may be actuated by the flow (driven by the flow 12 across the fans 48) or may be actuated by an external motive force (driven by, for example and electric motor (not shown)). In some embodiments, the fans 48 rotate about an axis 50 perpendicular to a direction of the flow 12 into the channels 14. In an alternative embodiment shown in FIG. 6, the axis 50 is substantially parallel to the direction of the flow 12 into the channels 14. As the flow 12 flows across the fans 48, the fans 48 rotate about the axis 50 and induce unsteadiness in the flow 12 to increase heat transfer in the channels 14.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A heat exchanger comprising:

a plurality of channels each defining a length; and a plurality of frame assemblies disposed along the length wherein each frame assembly includes:

a frame extending across the plurality of channels transverse to a primary direction of an incoming flow; and one or more active flow disruption members configured to actuate in the presence of the incoming flow and affixed to the frame and extending along the length of the plurality of channels, the one or more active flow disruption members extending along the primary direction of the incoming flow and the one or more active flow disruption members configured to induce unsteadiness in the flow through the plurality of channels to increase transfer of thermal energy therein.

2. The heat exchanger of claim 1, wherein at least one of the active flow disruption members is a rigid tab extending along the primary direction of the incoming flow.

3. The heat exchanger of claim 1, wherein the one or more active flow disruption members comprise one or more tabs or ribbons extending at least partially along a length of the plurality of channels.

4. The heat exchanger of claim 1, wherein the one or more active flow disruption members of one of the plurality of frame assemblies are disposed at entrances to the plurality of channels.

5. The heat exchanger of claim 1, wherein each channel of the plurality of channels is defined by adjacent heat transfer fins of a plurality of fins of the heat exchanger.

6. The heat exchanger of claim 1, wherein the plurality of frame assemblies comprises two or more frame assemblies disposed along the length of the plurality of channels.

* * * * *